US005560705A

United States Patent [19]

Shiau

[11] Patent Number: 5,560,705

[45] Date of Patent: Oct. 1, 1996

[54] MULTI-FUNCTION LIGHTING DEVICE

[76] Inventor: Shoei-Shuh Shiau, No. 10, Alley 1, Lane 551, Sec. 1, Wan-Shou Rd., Guei-Shan Hsiang, Tao-Yuan Hsien, Taiwan

[21] Appl. No.: 571,144

[22] Filed: Dec. 12, 1995

[51] Int. Cl.[6] ..... F21L 7/00

[52] U.S. Cl. ..... 362/188; 362/203

[58] Field of Search ..... 362/188, 203

[56] References Cited

U.S. PATENT DOCUMENTS 2,218,678 10/1940 Hoffman ..... 362/188

5,213,408 5/1993 Shiau ..... 362/203

*Primary Examiner*—Carroll B. Dority

*Attorney, Agent, or Firm*—Darby & Darby, P.C.

[57] ABSTRACT

A multi-function lighting device includes a barrel for housing a battery therein, a lamp base mounted in an externally threaded end of the barrel, a lamp provided on the lamp base, a switch unit disposed in the barrel for connecting selectively and electrically the battery to the lamp, and a head assembly. The head assembly includes a tubular coupling member which is threaded internally to engage threadably the barrel and which is provided with an inward push projection, a tubular sleeve member which is made of a light transmittable material and which is sleeved slidably on the coupling member, and a head cap which is secured to one end of the sleeve member and which is provided with a reflector therein. The sleeve member is shiftable with respect to the coupling member between a first position, wherein the lamp extends into the reflector so that light may be directed axially, and a second position, wherein the lamp is located in the sleeve member so that light can pass transversely through the sleeve member. The coupling member is shiftable with respect to the barrel so as to cause the push projection to depress the switch unit and control operation of the lamp.

15 Claims, 18 Drawing Sheets

MULTI-FUNCTION LIGHTING DEVICE

BACKGROUND OF THE INVENTION

1. Field of the Invention

The invention relates to a lighting device, more particularly to a multi-function variable focusing lighting device which can be operated as a flashlight and as a signaling baton.

2. Description of the Related Art

Referring to FIG. 1, a conventional variable focusing flashlight disclosed in U.S. Pat. No. 5,213,408 is shown to comprise a conductive barrel 10 for housing a battery 12 therein, a tail cap 13 mounted on one end of the barrel 10 and provided with a compression spring 131 for urging the battery 12 towards the other end of the barrel 10, a lamp base 11 for mounting a lamp 14 adjacent to the other end of the barrel 10, and a head assembly 17 mounted rotatably on the other end of the barrel 10 and provided with a planar lens 171 and a parabolic reflector 170 with an open tail end to receive the lamp 14. First and second conductors 113, 114 are mounted in the lamp base 11 and are connected electrically and respectively to lamp terminals of the lamp 14. A push member 111 extends through the lamp base 11 and has a first end abutting against the battery 12 and a second end abutting against the open tail end of the reflector 170. The first conductor 113 has one end extending radially along the bottom side of the lamp base 11 within the barrel 10. The second conductor 114 couples electrically the lamp 14 and the barrel 10.

The head assembly 17 is mounted threadedly to the barrel 10 so as to be controllably translatable therealong when rotated with respect to the barrel 10, thereby resulting in a variable focusing effect. Rotation of the head assembly 17 in a direction to result in movement toward the barrel 10 eventually causes the reflector 170 to push the push member 111 and the battery 12 and move the battery 12 away from the first conductor 113, thereby breaking electrical connection between the lamp 14 and the battery 12.

In the aforementioned conventional flashlight, rotation of the head assembly 17 is performed to activate and vary focusing of the flashlight. Since the light output of the conventional flashlight is directed only through the head assembly 17, the flashlight is not ideal for use as a lantern or as a signaling baton.

Referring to FIGS. 2, 3 and 4, a conventional multi-function lighting device disclosed in U.S. Pat. No. 5,412,548 is shown to comprise a head section 18 and an elongate handle 19. The head section 18 includes a slidable coupling 180 which is sleeved on the elongate handle 19 so as to be longitudinally shiftable over the latter, an axially extending elongate sleeve 181 which is secured to and shiftable with the coupling 180 and which is made of a transparent or translucent material so as to permit transmission of light therethrough, and an end cap 182 which is secured to the elongate sleeve 18] and which has a reflector 191 provided therein. A light source 190 is mounted on one end of the elongate handle 19. By shifting the head section 18 over the elongate handle 19, the light source 190 may be made to project into the reflector 191 in the same manner as an ordinary flashlight, as shown in FIG. 2, or may be located within the elongate sleeve 181 to permit use of the lighting device as a signaling baton, as shown in FIG. 3.

Although the head section 18 is longitudinally shiftable over the elongate handle 19, the head section 18 cannot be maintained at a desired position relative to the elongate handle 19. Thus, the conventional lighting device cannot maintain a desired focusing effect.

SUMMARY OF THE INVENTION

Therefore, the main object of the present invention is to provide a multi-function variable focusing lighting device which can be operated as a flashlight and as a signaling baton.

Another object of the present invention is to provide a multi-function variable focusing lighting device which is capable of providing a blinking light output.

According to one aspect of the present invention, a multi-function lighting device comprises: a barrel for housing a battery therein, the barrel having one end which is threaded externally; a lamp base mounted in the barrel; a lamp provided on the lamp base; a switch unit disposed in the barrel for connecting selectively and electrically the battery to the lamp; and a head assembly including a tubular coupling member threaded internally to engage threadably the barrel and provided with an inward push projection, a tubular sleeve member made of a light transmittable material and sleeved slidably on the coupling member, and a head cap secured to one end of the sleeve member and provided with a reflector therein. The sleeve member is shiftable with respect to the coupling member between a first position, wherein the lamp extends into the reflector so that light may be directed axially, and a second position, wherein the lamp is located in the sleeve member so that light can pass transversely through the sleeve member. The coupling member is shiftable with respect to the barrel so as to cause the push projection to depress the switch unit and control operation of the lamp.

According to another aspect of the present invention, a multi-function lighting device comprises: a barrel for housing a battery therein; a lamp base mounted in the barrel and formed with a through bore therethrough; a lamp provided on the lamp base; a head assembly including a tubular coupling member secured to the barrel, a tubular sleeve member made of a light transmittable material and sleeved slidably on the coupling member, and a head cap secured to one end of the sleeve member and provided with a reflector therein; a switch assembly mounted in the barrel and connected electrically to the battery and the lamp, the switch assembly being operable so as to interconnect electrically and selectively the battery and the lamp; and a push member which extends slidably through the through bore of the lamp base and which has a first end abutting against the switch assembly and a second end. The sleeve member is shiftable with respect to the coupling member between a first position, wherein the lamp extends into the reflector so that light may be directed axially, and a second position, wherein the lamp is located in the sleeve member so that light can pass transversely through the sleeve member. Shifting of the sleeve member to the first position causes the reflector to depress the second end of the push member to result in operation of the switch assembly by the push member.

According to a further aspect of the present invention, a multi-function lighting device comprises: a conductive barrel for housing a battery therein; a lamp socket assembly mounted in one end of the barrel, the lamp socket assembly including a conductive tubular lamp holder with a lamp retained thereon, a connector unit which extends into the lamp holder and which is connected electrically to the lamp, a conductive coupling unit disposed around the lamp holder to connect electrically the barrel and the lamp holder, a press ring disposed slidably around the lamp holder, a spring for biasing the press ring outwardly of the barrel, and a mounting unit for retaining the lamp holder and the coupling unit in the barrel, the mounting unit having a through bore formed therethrough; a head assembly including: a tubular coupling member secured to the barrel and provided with an inward push projection which is disposed above and which abuts normally against the press ring; a tubular sleeve member made of a light transmittable material and sleeved slidably on the coupling member; and a head cap secured to one end of the sleeve member and provided with a reflector therein; a switch assembly mounted in the barrel and connected electrically to the battery and the connector unit, the switch assembly being operable so as to interconnect electrically and selectively the battery and the lamp; and a push member which extends slidably through the through bore of the mounting unit and which has a first end abutting against the switch assembly and a second end abutting against the press ring. The sleeve member is shiftable with respect to the coupling member between a first position, wherein the lamp extends into the reflector so that light may be directed axially, and a second position, wherein the lamp is located in the sleeve member so that light can pass transversely through the sleeve member. Shifting of the sleeve member to the first position causes the reflector to depress the press ring to result in corresponding movement of the push member for operating the switch assembly.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
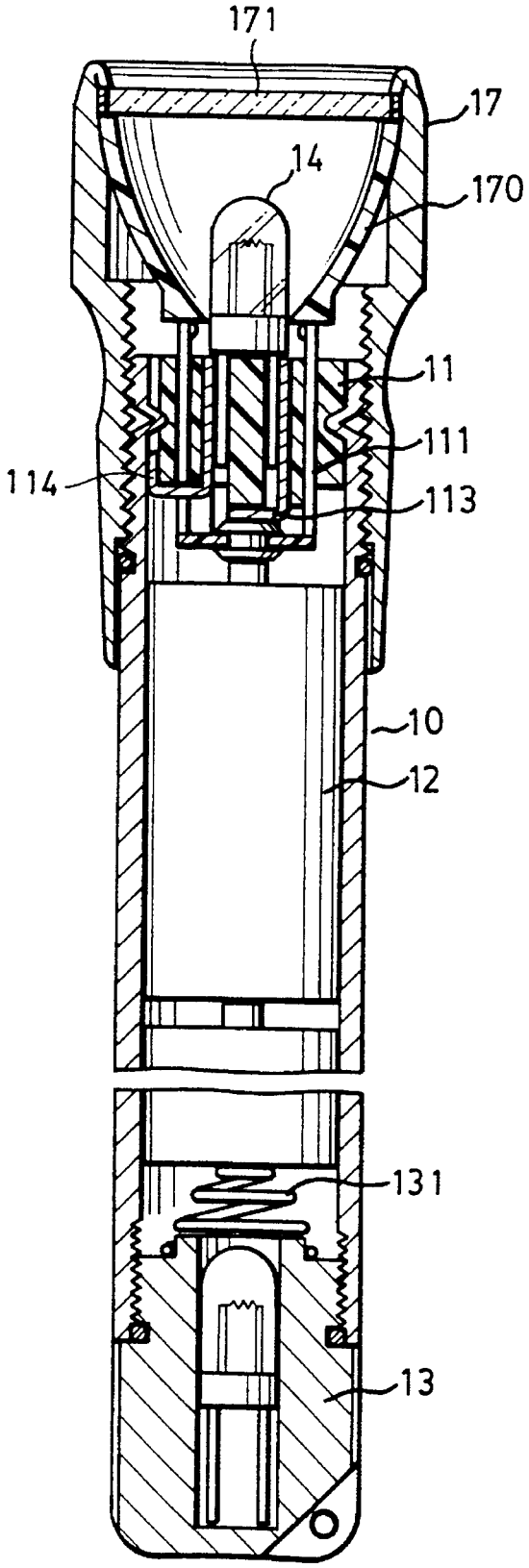
FIG. 1 PRIOR ART
FIG. 1 is a sectional view of a conventional variable focusing flashlight disclosed in U.S. Pat. No. 5,213,408.
Figure 2:
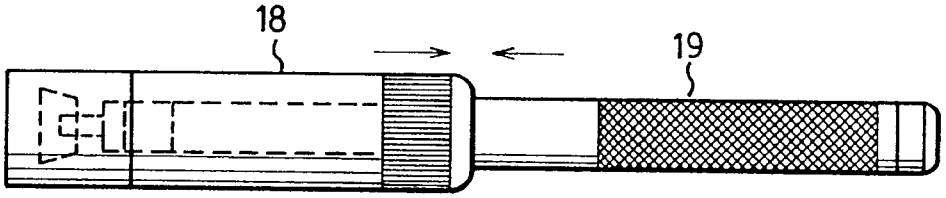
FIG.2 PRIOR ART
FIG. 2 is a side elevation view of a conventional multi-function lighting device disclosed in U.S. Pat. No. 5,412,548 when operated in a flashlight mode.
Figure 3:
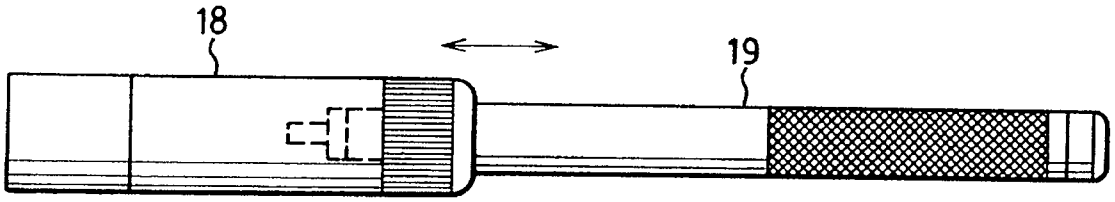
FIG.3 PRIOR ART
FIG. 3 is a side elevation view of the conventional lighting device shown in FIG. 2 when operated as a signaling baton.
Figure 4:
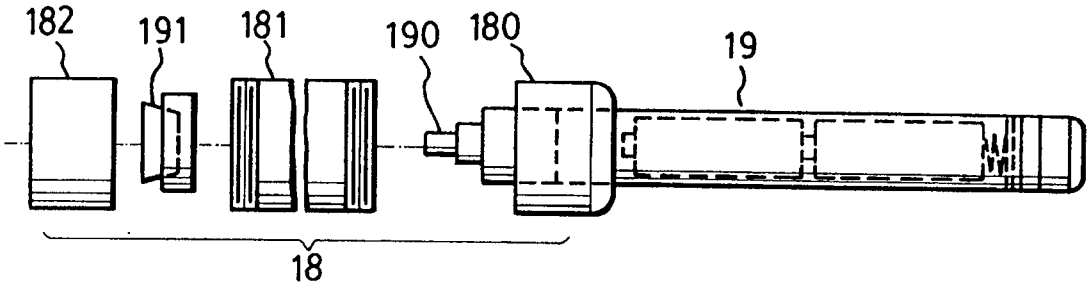
FIG.4 PRIOR ART
FIG. 4 is an exploded side elevation view of the conventional lighting device shown in FIG. 2.

Before the present invention is described in greater detail, it should be noted that like elements are generally denoted by the same reference numerals throughout the disclosure.

Figure 5:
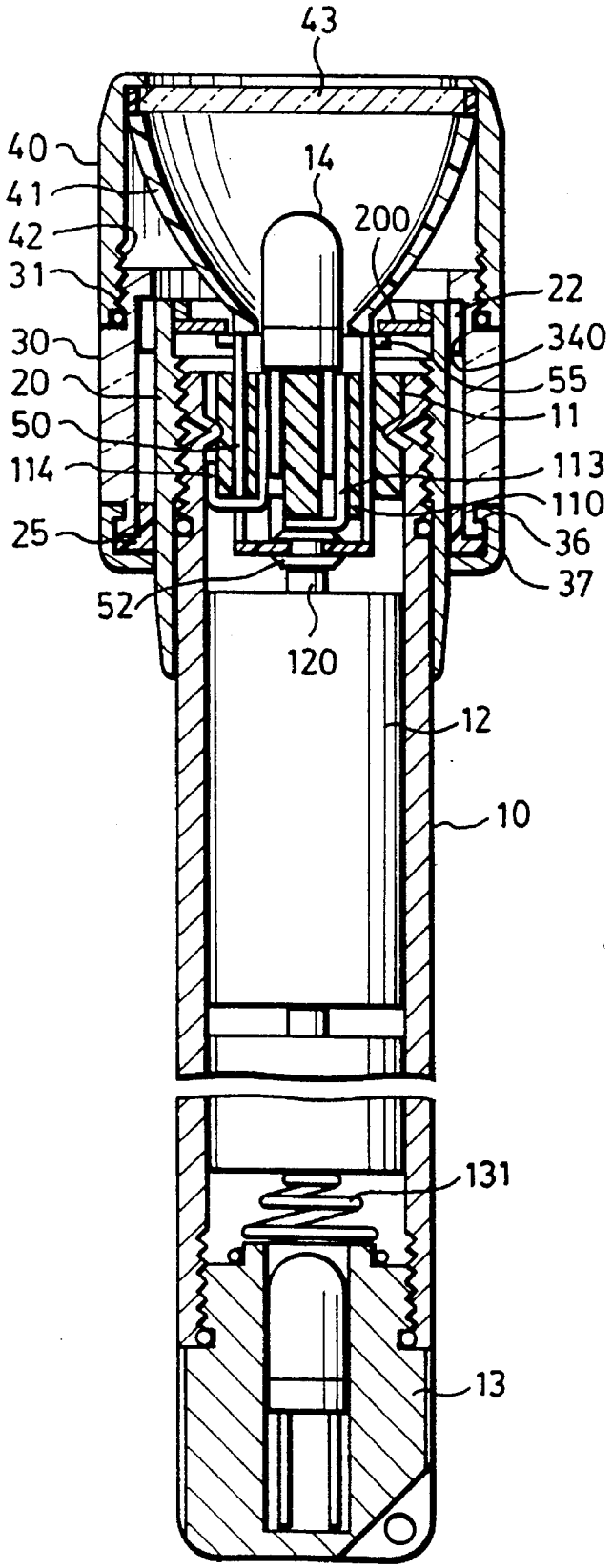
FIG. 5 is a sectional view of the first preferred embodiment of a multi-function lighting device according to the present invention.

Referring to FIG. 5, the first preferred embodiment of a multi-function lighting device according to the present invention is shown to comprise a conductive barrel 10, a lamp base 11, a lamp 13, a switch unit which includes a push member 50, and a head assembly which includes a coupling member 20, a sleeve member 30 and a head cap 40.

The barrel 10 is similar to that of the conventional variable focusing flashlight shown in FIG. 1 and is used to house a battery 12 therein. The front end of the barrel 10 is formed with an external screw thread 16.

Figure 7:
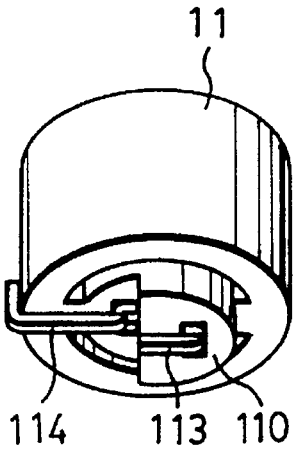
FIG. 7 is a bottom perspective view of the lamp base shown in FIG. 6.
Figure 6:
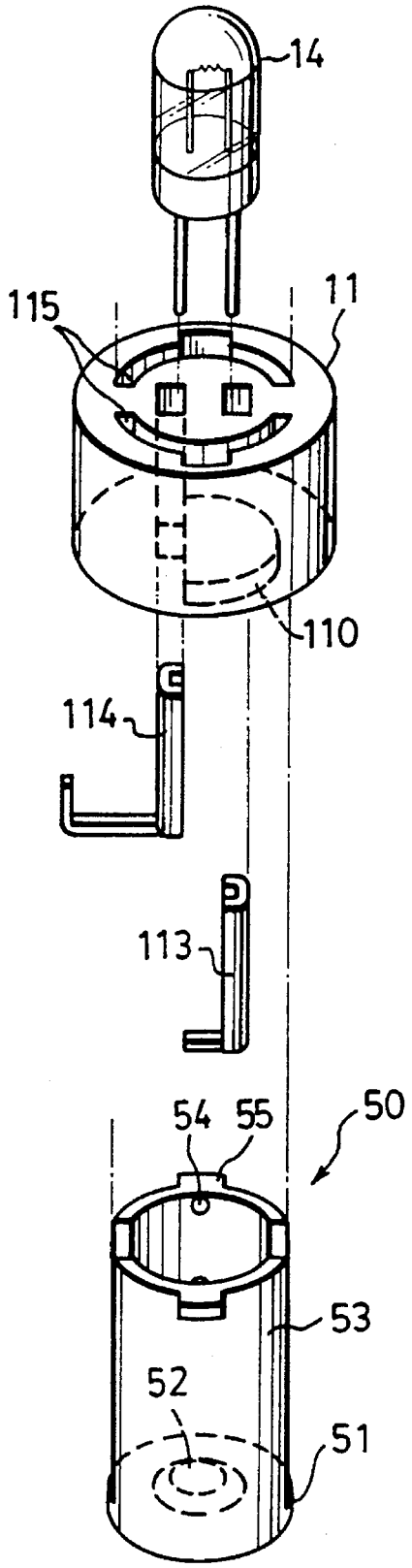
FIG. 6 is an exploded view which illustrates a lamp base and a push member of the first preferred embodiment.

The lamp base 11 is mounted in a front end of the barrel 10 and is made of an insulator material. The push member 50, which is also made of an insulator material, extends through the lamp base 11. As shown in FIGS. 6 and 7, the bottom side of the lamp base 11 has a central portion formed with a downwardly extending projection 110. First and second conductors 113, 114 are mounted in the central portion of the lamp base 11. The first conductor 113 has a bent end which extends along the bottom face of the projection 110 for electrical contact with the positive terminal 120 of the battery 12, as shown in FIG. 5. The second conductor 114 has a bent end which extends along the bottom side of the lamp base 11 and then upwardly so as to be clamped between the lamp base 11 and the barrel 10 and achieve constant electrical contact with the barrel 10. The lamp base 11 is further formed with a pair of arcuate through bores 115 on two sides of the central portion thereof. The lamp 14 has two terminals which extend into the central portion of the lamp base 11 and which are connected electrically and respectively to the first and second conductors 113, 114.

Figure 8:
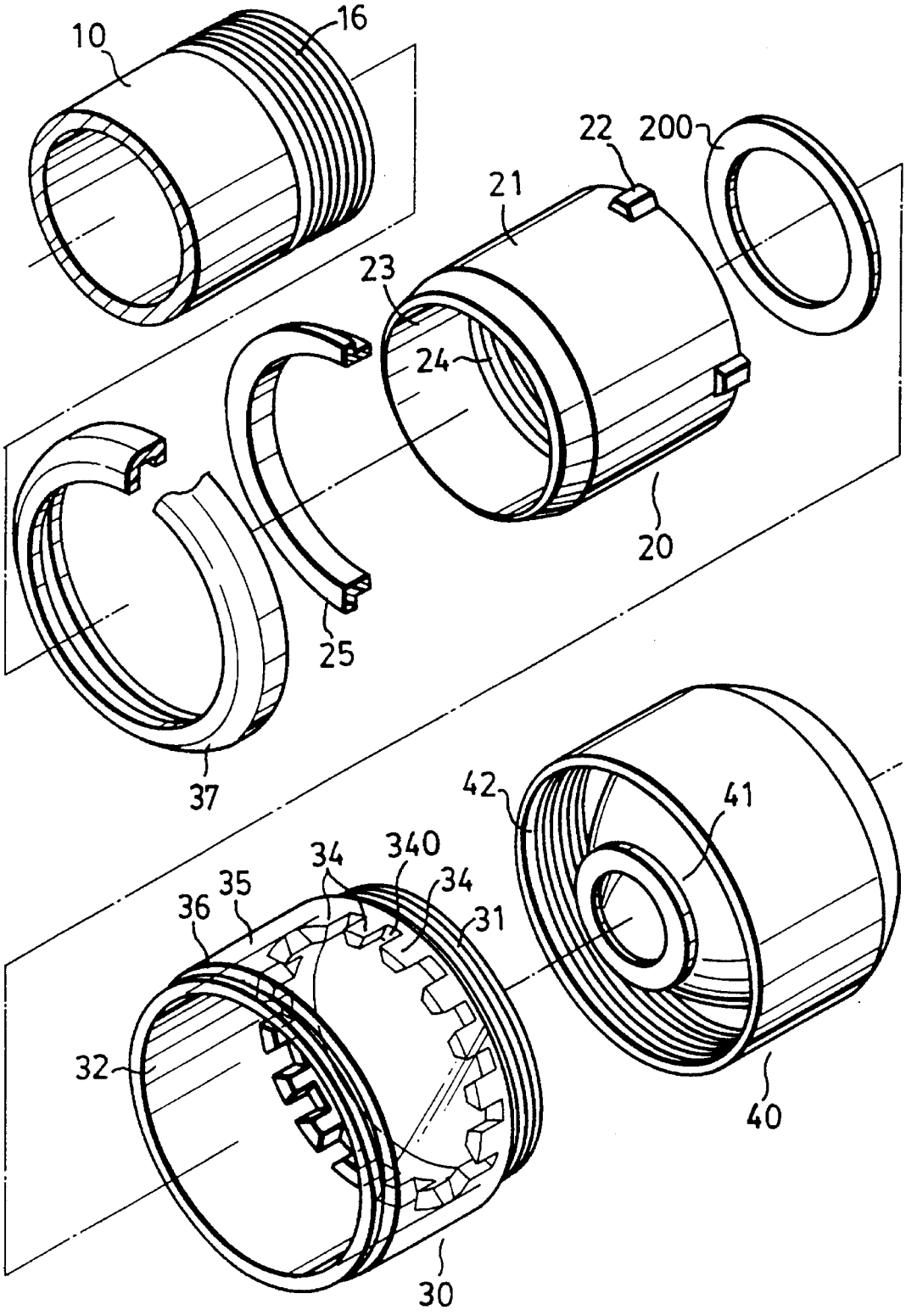
FIG. 8 is an exploded perspective view of a head assembly of the first preferred embodiment.

The push member 50 has a plate portion 51 disposed between the lamp base 11 and the battery 12. The plate portion 51, which is formed with an opening, has a conductive rivet 52 that is provided in the opening and that serves as an electrical contact for making or breaking electrical connection between the first conductor 113 and the positive terminal 120 of the battery 12. The push member 50 is further provided with a pair of arcuate extensions 53 which extend upwardly and slidably through the through bores 115 in the lamp base 11 and which are formed integrally with the plate portion 51. Each of the arcuate projections 53 has an upper end which is provided with an inward protrusion 54 and a radial outward flange 55. The protrusions 54 limit movement of the push member 50 relative to the lamp base 11 and prevent disengagement therebetween. Referring to FIGS. 5 and 8, the coupling member 20 is formed as a cylindrical tube and has an outer wall surface 21 formed with at least one radial locking projection 22, and an inner wall surface 23 formed with a screw thread 24 for engaging threadedly the screw thread 16 on the front end of the barrel 10. An inward push projection 200, which is formed as an annular plate, is secured to the inner wall surface 23 at the front end of the coupling member 20. A seal ring 25 is disposed around the outer wall surface 21 at the rear end of the coupling member 20.

The sleeve member 30 is formed as an elongate cylindrical tube that is made of a transparent or translucent material so as to permit the transmission of light therethrough. Preferably, the sleeve member 30 is made of a colored, light transmittable material. The sleeve member 30 has a front end portion 300 formed with a screw thread 31 at an outer wall surface 35 and a plurality of angularly spaced splines 34 at an inner wall surface 32. Adjacent splines 34 define a spline groove 340 therebetween for engaging removably the locking projection 22 on the coupling member 20. The sleeve member 30 further has a rear end portion formed with an annular retaining groove 36 for engaging an annular cap 37.

The head cap 40 is provided with a planar lens 43 and a parabolic reflector 41 with an open tail end to receive the lamp 14. The head cap 40 has an inner wall surface that is formed with a screw thread 42 for engaging threadedly the screw thread 31 on the sleeve member 30.

Assembly of the first preferred embodiment is as follows:

After the push member 50 has been mounted thereon, the lamp base 11 is inserted into the front end of the barrel 10 such that the conductive rivet 52 is in contact with the positive terminal 120 of the battery 12 and the first conductor 113. Thereafter, pressure is exerted on the surface of the barrel 10 so as to dent a portion of the same. The dented portion extends into the surface of the lamp base 11, thereby securing the lamp base 11 in the barrel 10 and tightly clamping the second conductor 114 between the barrel 10 and the lamp base 11. The lamp 14 is then provided on the lamp base 11. To install the head assembly, the annular cap 37 and the seal ring 25 are initially removed from the sleeve member 30 and the coupling member 20, respectively. The coupling member 20 is then inserted through the sleeve member 30 via the rear end portion of the latter. Afterwards, the seal ring 25 is disposed around the rear end of the coupling member 20, and the sealing cap 37 is engaged within the retaining groove 36 of the sleeve member 30. Thereafter, the coupling member 20 is mounted on the barrel 10 by virtue of engagement between the screw threads 16, 24, and the head cap 40 is mounted on the sleeve member 30 by virtue of engagement between the screw threads 31, 42. At this time, the push projection 200 in the coupling member 20 is disposed above the flanges 55 on the push member 50.

Figure 9:
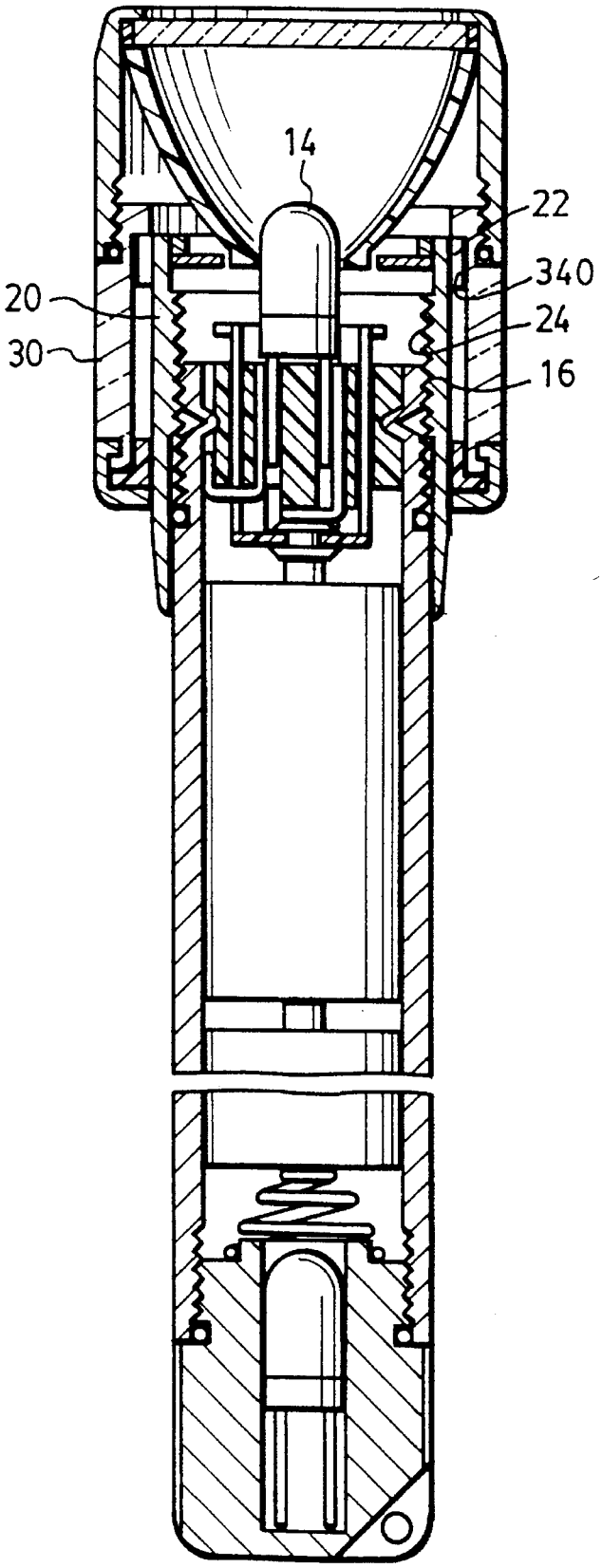
FIG. 9 is a sectional view illustrating how focusing of the first preferred embodiment is varied.

As shown in FIG. 5, when the first preferred embodiment is operated in a flashlight mode, the head assembly is pulled toward the barrel 10 so that the lamp 14 extends into the reflector 41 in order to direct light axially. Light is unable to pass through the sleeve member 30 at this time. It is noted that direct rotation of the coupling member 20 relative to the barrel 10 is not possible when it is desired to vary the focusing of the lighting device of the first preferred embodiment since the coupling member 20 is concealed within the sleeve member 30. However, in view of the engagement between the locking projection 22 on the coupling member 20 and the splines 34 on the sleeve member 30, rotation of the sleeve member 30 will cause the coupling member 20 to rotate therewith, as shown in FIG. 9. Since the screw threads 16, 24 mount adjustably the coupling member 20 on the barrel 10, rotation of the sleeve member 30 relative to the barrel 10 can cause the coupling member 20 to shift with respect to the barrel 11, thereby varying the degree of extension of the lamp 14 into the reflector 41 to attain the desired focusing effect.

Figure 10:
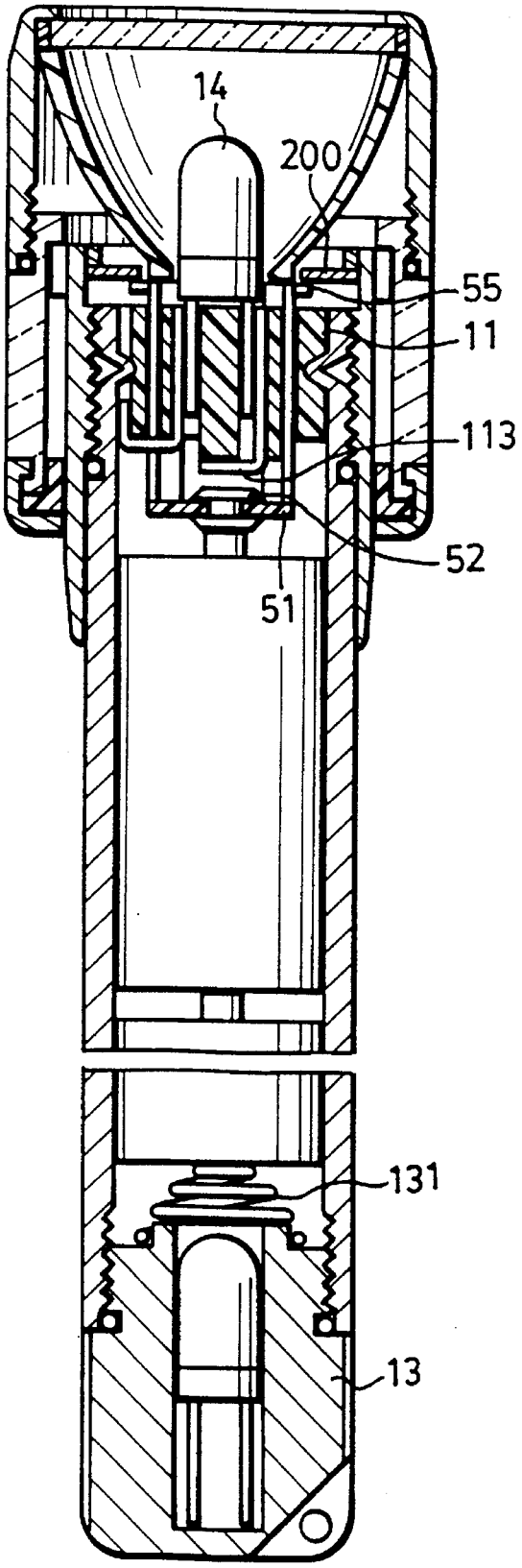
FIG. 10 is a sectional view illustrating how the first preferred embodiment is deactivated.

Referring to FIG. 10, rotation of the sleeve member 30 in a first direction causes the push projection 200 in the coupling member 20 to abut against the flanges 55 on the push member 50 and push the arcuate extensions 53 downwardly through the through bores 115 in the lamp base 11, thereby separating the conductive rivet 52 on the plate portion 51 from the first conductor 113 to break electrical connection between the lamp 14 and the battery 12. The lighting device is deactivated at this time. Activation of the lighting device is achieved by rotating the sleeve member 30 in an opposite second direction to cause the compression spring 131 of the tail cap 13, which is mounted on a rear end of the barrel 10, to expand and push the battery 12 and the push member 50 toward the lamp base 11, thereby permitting contact between the conductive rivet 52 and the first conductor 113 to connect electrically the lamp 14 and the battery 12.

Figure 11:
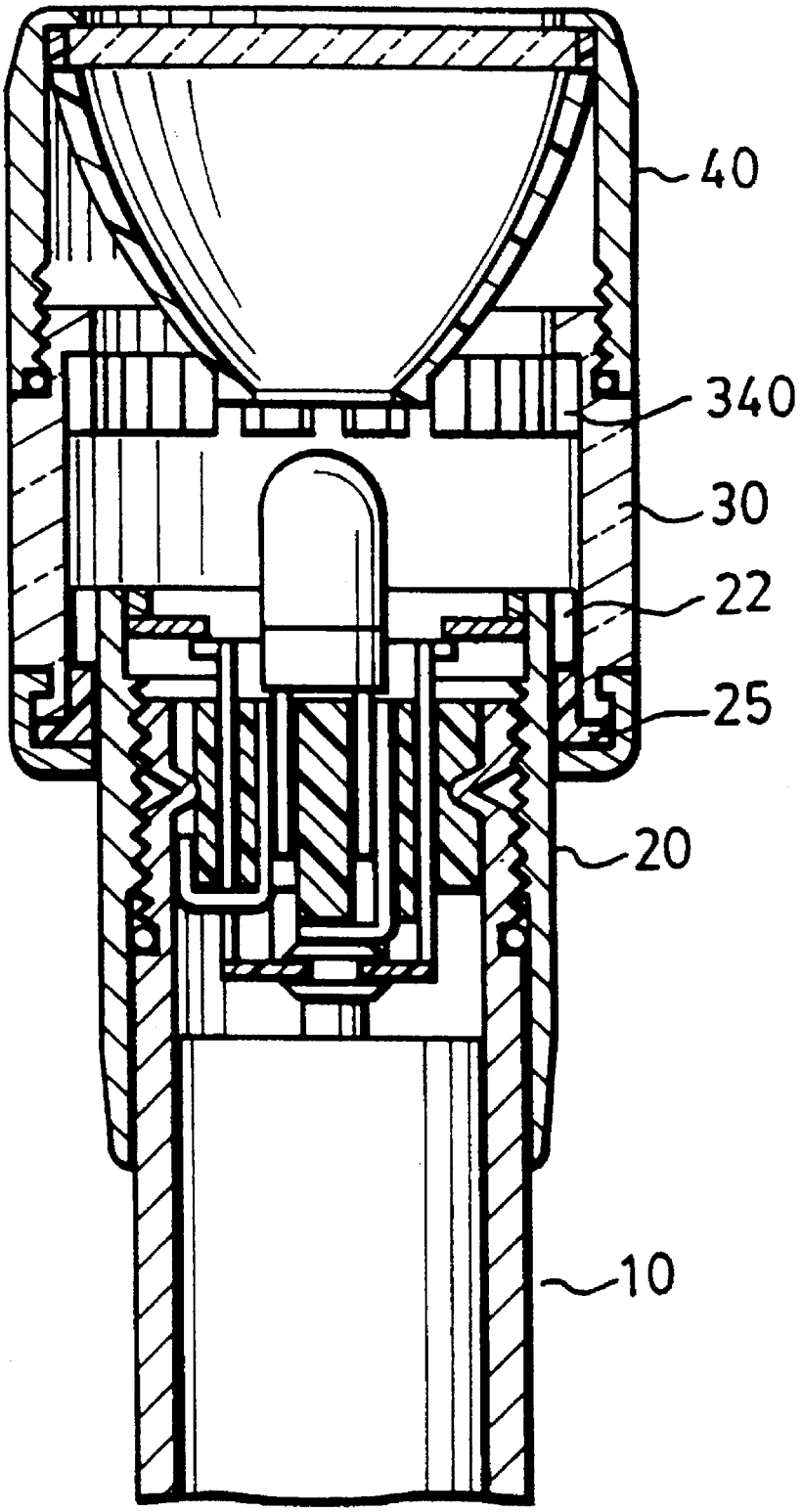
FIG. 11 is a fragmentary sectional view illustrating the first preferred embodiment when operated as a signaling baton.

When operating the first preferred embodiment as a signaling baton, the head assembly is pulled away from the barrel 10 so as to shift the sleeve member 30 with respect to the coupling member 20 such that the coupling member 20 ceases to be concealed within the sleeve member 30, as shown in FIG. 11. Since the locking projection 22 on the coupling member 20 ceases to engage the splines 34 on the sleeve member 30, rotation of the sleeve member 30 will not result in corresponding rotation of the coupling member 20. The seal ring 25 abuts against the locking projection 22 to limit movement of the sleeve member 30 relative to the coupling member 20, and the annular cap 37 prevents removal of the seal ring 25. At this time, the lamp 14 is located in the sleeve member 30 so that light can pass transversely through the sleeve member 30.

Aside from providing a waterproofing effect, the seal ring 25, which is disposed around the coupling member 20, is in tight frictional contact with the coupling member 20 and the sleeve member 30 to provide resistance to sliding movement of the sleeve member 30 relative to the coupling member 20. Thus, when the first preferred embodiment is placed uprightly and face down on a flat surface, such as a table top, the sleeve member 30 can be retained at a desired position with respect to the coupling member 20 to permit operation of the lighting device as a lantern.

In the first preferred embodiment, the push member 50 serves as a switch unit for making or breaking electrical connection between the first conductor 113 and the positive terminal 120 of the battery 12. Note that the lighting device of this embodiment is still operable even if no rivet 52 is provided in the opening of the plate portion 51 of the push member 50. Under this condition, the compression spring 131 in the tail cap 13 urges the battery 12 so that the positive terminal 120 of the latter extends into the opening and serves as the electrical contact for making or breaking electrical connection with the first conductor 113.

Figure 12:
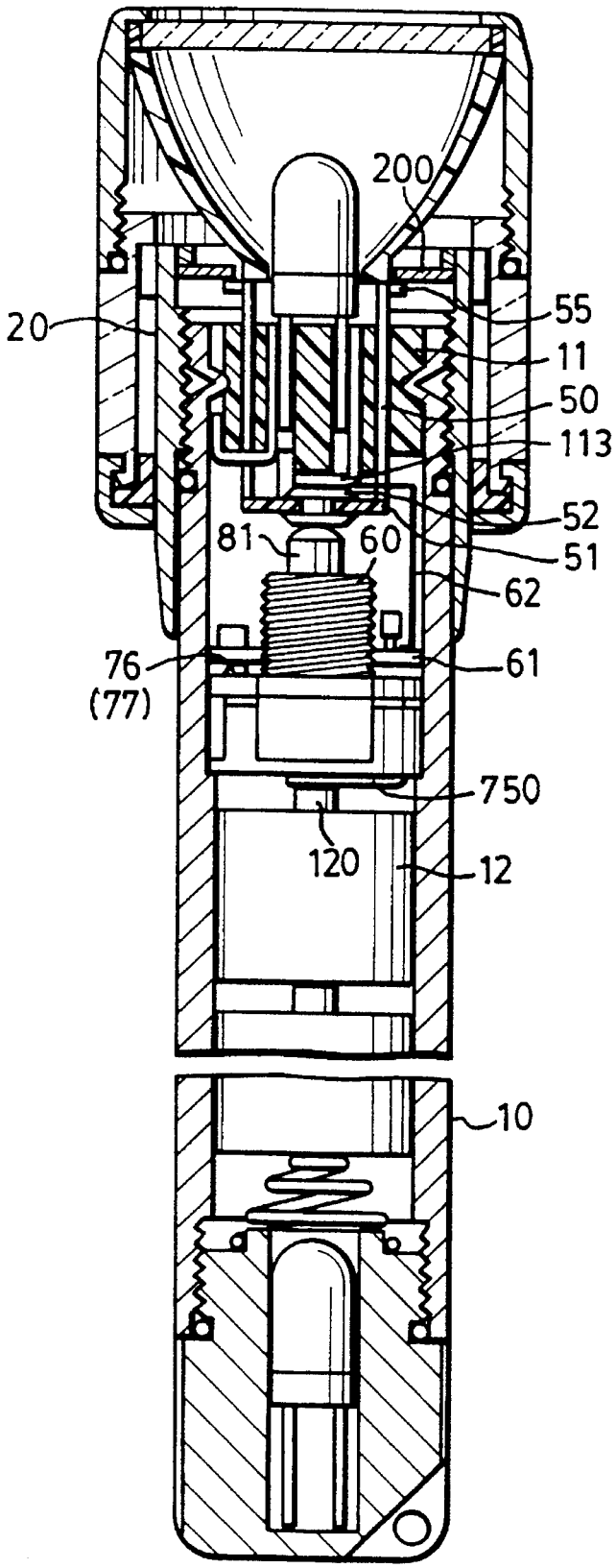
FIG. 12 is a sectional view of the second preferred embodiment of a multi-function lighting device according to the present invention.
Figure 13:
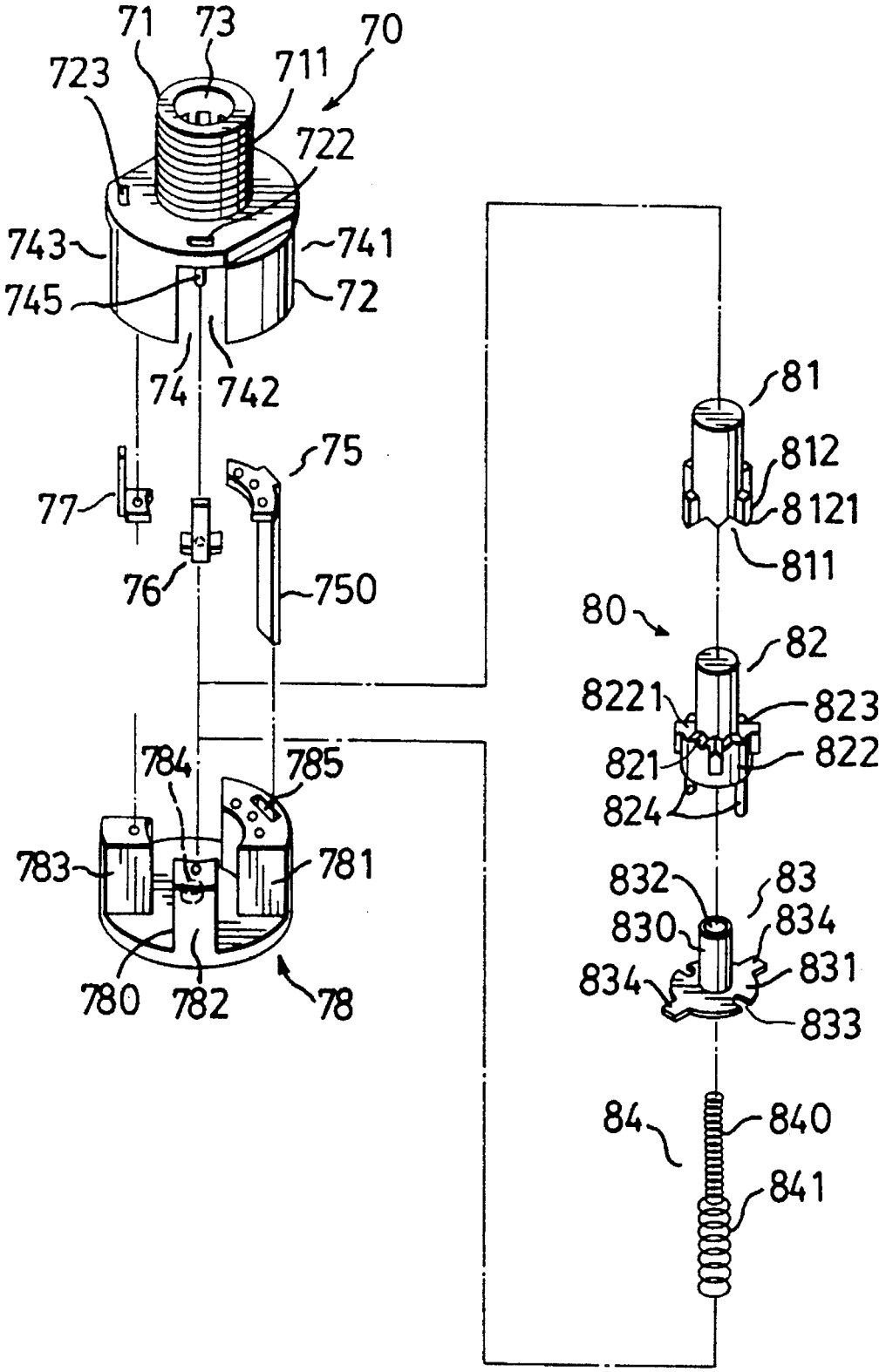
FIG. 13 is an exploded perspective view of a switch assembly of the second preferred embodiment.

Referring to FIG. 12, the second preferred embodiment of a multi-function lighting device according to the present invention is shown to be substantially similar to the first preferred embodiment. In the second preferred embodiment, however, the push member 50 serves as a switch actuator for actuating a switch assembly 60 which is installed in the barrel 10 between the battery 12 and the plate portion 51 of the push member 50. The switch assembly 60 is connected electrically to the positive terminal 120 of the battery 12 in the barrel 10 and to a pulse generating circuit 90 (see FIG. 15) on a circuit board 61. A conductor connects electrically the pulse generating circuit 90 to the lamp 14 via the first conductor 113. Referring to FIG. 13, the switch assembly 60 includes a seat member 70, a spring-loaded button unit 80 and a conductive connector 83.

Figure 14:
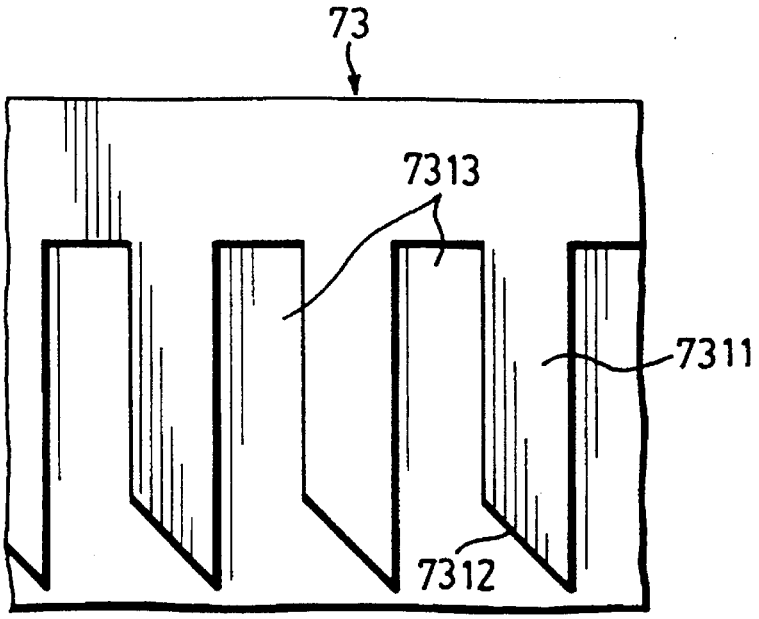
FIG. 14 is a fragmentary enlarged view in which an annular inner wall of a cylindrical head of a seat member of the switch assembly is translated onto a plane.
Figure 18:
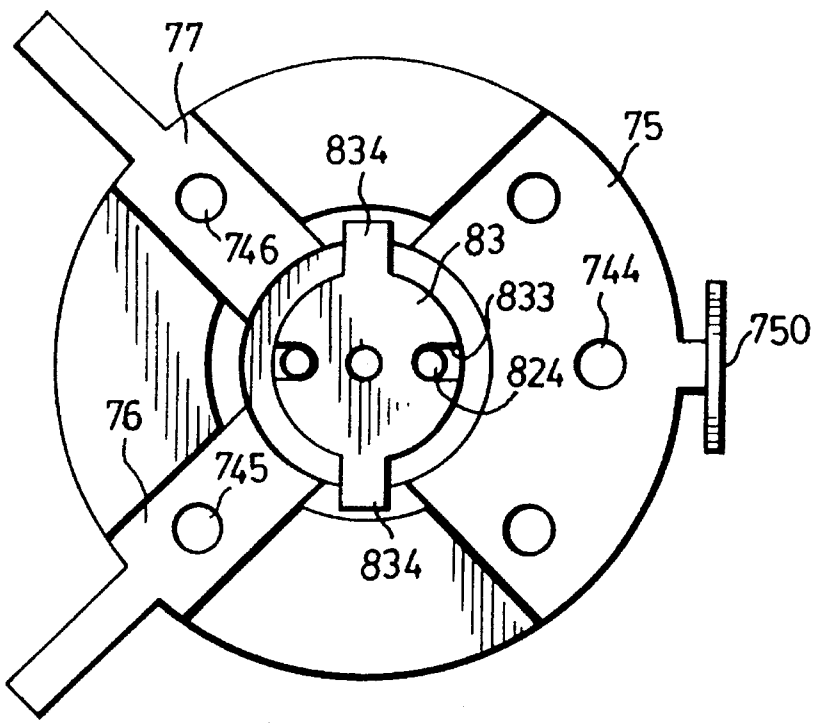
FIG. 18 is a bottom view illustrating a conductive connector and electrical contacts on the seat member when the connector is in a switch-off position.

The seat member 70 includes a hollow cylindrical base 72 and a hollow cylindrical head 71 that extends from the cylindrical base 72. The cylindrical head 71 has an outer wall surface formed with a screw thread 711 which engages the circuit board 61 to retain the seat member 70 on the latter, as shown in FIG. 12. The cylindrical base 72 has a top end formed with a pair of openings 722, 723. The cylindrical head 71 and the cylindrical base 72 respectively confine first and second chambers 73, 74. Referring to FIG. 14, the first chamber 73 is confined by an annular inner wall surface which is formed with a plurality of angularly spaced and vertically extending ribs 7311 that define a plurality of slide grooves 7313. Each rib 7311 has an inclined lowermost end surface 7312 which slopes from one adjacent slide groove 7313 to another adjacent slide groove 7313. In the present embodiment, the seat member 70 is provided with eight ribs 7311. Referring again to FIG. 13, the cylindrical base 72 is formed with three angularly spaced and axially extending slits 741, 742, 743, and three downwardly projecting positioning pins 744, 745, 746 disposed adjacent to the slits 741, 742, 743, respectively, as shown in FIG. 18. The seat member 70 is made of an insulator material and has first, second and third electrical contacts 75, 76, 77 mounted thereon. In this embodiment, the electrical contacts 75, 76, 77 extend radially into the cylindrical base 72 via the slits 741, 742, 743 and are secured respectively to the positioning pins 744, 745, 746. The first electrical contact 75 is formed with a downwardly extending contact plate portion 750. A bottom cover 78 is secured to the cylindrical base 72 to close the bottom end of the latter. The bottom cover 78 is formed with three angularly spaced and upwardly extending wall segments 781, 782, 783 which extend respectively into the slits 741, 742, 743 of the cylindrical base 72 for supporting the electrical contacts 75, 76, 77 on the positioning pins 744, 745, 746. The plate portion 750 of the first electrical contact 75 extends through a vertical through hole 785 formed in the corresponding wall segment 781, and is bent so as to extend along a bottom side of the bottom cover 78. The second and third electrical contacts 76, 77 extend respectively through the openings 722, 723 formed in the top end of the cylindrical base 72. As shown in FIG. 12, the plate portion 750 of the first electrical contact 75 is in contact with the positive terminal 120 of the battery 12. The second electrical contact 76 is connected electrically to the first conductor 113. The third electrical contact 77 is connected to the pulse generating circuit 90 on the circuit board 61.

Referring once more to FIG. 13, the button unit 80 includes a tubular push rod 81, a tubular rotatable rod 82 and a coil spring 84.

Figure 16:
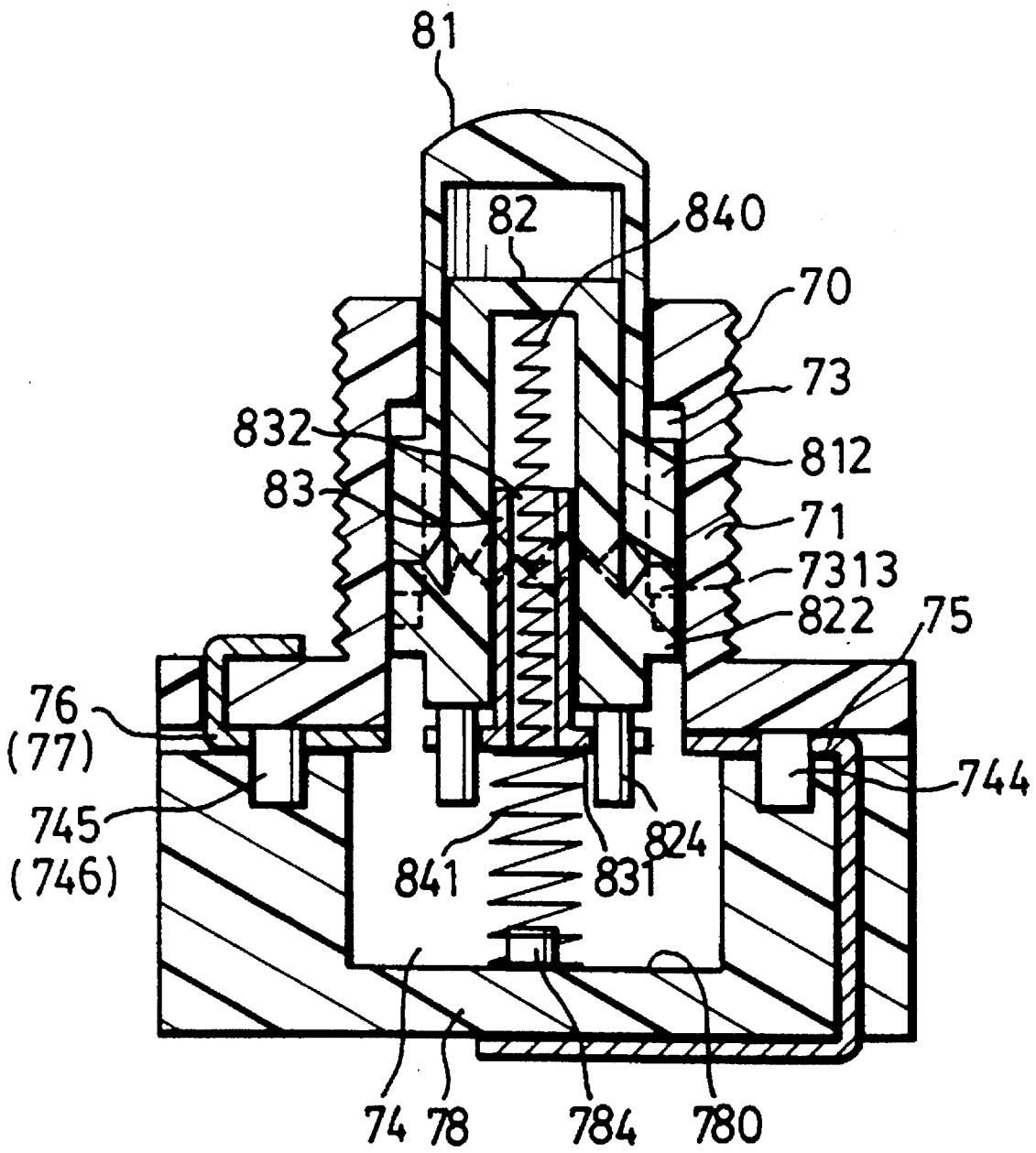
FIG. 16 is a sectional view of the switch assembly of the second preferred embodiment.

The rotatable rod 82 has a closed upper end portion and an open lower end portion. The lower end portion is formed with an outwardly extending radial flange 821. The radial flange 821 has a plurality of angularly spaced protrusions 822 which project outwardly and radially therefrom. In this embodiment, the radial flange 821 is formed with four protrusions 822. Each of the protrusions 822 has an inclined uppermost end surface 8221 which complements the inclined lowermost end surface 7312 of the ribs 7311. The protrusions 822 extend movably and respectively into the slide grooves 7313. The radial flange 821 further has an upper end surface formed with a plurality of angularly arranged teeth 823. The rotatable rod 82 further has two diametrically opposite connecting pins 824 which extend downwardly. The rotatable rod 82 is to be disposed movably and rotatably in the cylindrical head 71 of the seat member 70, as shown in FIG. 16.

The push rod 81 is disposed movably in the cylindrical head 71 and is sleeved on the rotatable rod 82. The push rod 81 has a closed upper end portion and an open lower end portion formed with a plurality of angularly arranged teeth 811 and a plurality of angularly spaced projections 812. In this embodiment, the push rod 81 is formed with four projections 812. The projections 812 project outwardly and radially from the lower end portion of the push rod 81 and respectively have an inclined lowermost end 8121. Like the protrusions 822, the projections 812 also extend movably and respectively into the slide grooves 7313.

The conductive connector 83 is disposed rotatably in the seat member 70 and includes a conductive base plate 831 and a tubular shaft 830 which extends upwardly from the base plate 831. The tubular shaft 830 confines an axial through-hole 832 therethrough. The base plate 831 has a periphery formed with a pair of diametrically opposite retaining notches 833 and a pair of diametrically opposite and outwardly extending conductive contacts 834. The rotatable rod 82 is sleeved on the tubular shaft 830 such that the connecting pins 824 extend through the retaining notches 833, thereby enabling the conductive connector 83 to rotate with the rotatable rod 82, as shown in FIG. 16. Rotation of the conductive connector 83 enables the conductive contacts 834 to make or break electrical connection with the electrical contacts 75, 76, 77 on the seat member 70.

The coil spring 84 has an upper section 840 and a lower section 841 which is wider than the upper section 840. The conductive connector 83 is sleeved on the coil spring 84 such that the upper section 840 of the latter extends through the through-hole 832 in the tubular shaft 830 to abut against the upper end portion of the rotatable rod 82 in order to maintain a clearance between the lower end portion of the rotatable rod 82 and the base plate 831 of the conductive connector 83, and such that the base plate 831 is supported on the lower section 841 of the coil spring 84 to bias the base plate 831 upwardly to achieve proper contact with the electrical contacts 75, 76, 77. The lower section 841 of the coil spring 84 is then retained on a spring guide 784 that is formed on a base plate 780 of the bottom cover 78.

Figure 15:
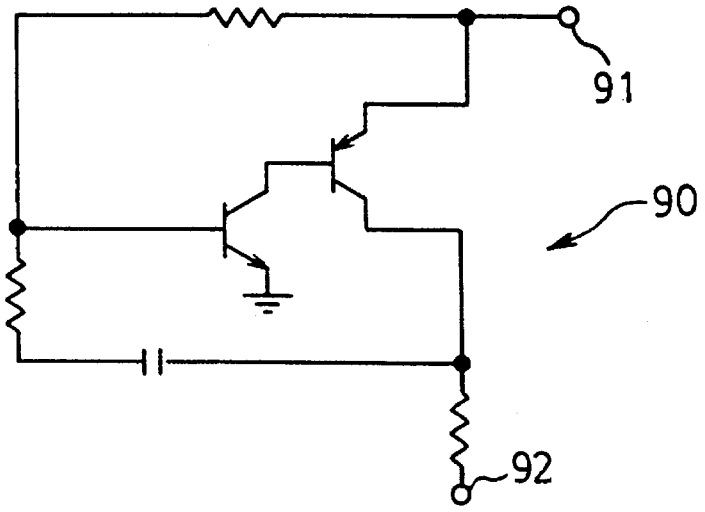
FIG. 15 is a schematic electrical circuit diagram of a pulse generating circuit of the second preferred embodiment.

Referring now to FIG. 15, the pulse generating circuit 90 used in this embodiment is configured as a charge-discharge circuit and has an input terminal 92 which is connected electrically to the third electrical contact 77 on the seat member 70, and an output terminal 93 which is connected electrically to the lamp 14 via the first conductor 113. A pulse train signal is generated at the output terminal 93 whenever the input terminal 92 is connected to the battery 12 via the conductive connector 83 and the first electrical contact 75.

Referring to FIG. 16, the switch assembly 60 is assembled as follows: The push rod 81 is extended into the seat member 70 such that the projections 812 on the push rod 81 extend into the slide grooves 7313 between the ribs 7311 in the cylindrical head 71 of the seat member 70 and such that the push rod 81 extends out of the cylindrical head 71. The rotatable rod 82 is then extended into the push rod 81 via the open lower end portion of the latter. At this time, the protrusions 822 on the rotatable rod 82 also extend into the slide grooves 7313 of the seat member 70. The conductive connector 83 and the coil spring 84 are installed afterward. As mentioned beforehand, the upper section 840 of the coil spring 84 extends through the through-hole 832 in the tubular shaft 830 of the conductive connector 83 to abut against the upper end portion of the rotatable rod 82. The bottom cover 78 is then installed on the cylindrical base 72 of the seat member 70 to close the second chamber 74. The lower section 841 of the coil spring 84 is retained on the spring guide 784 of the bottom cover 78 at this time. The seat member 70 is then mounted threadedly on the circuit board 61 (see FIG. 12).

Figure 17:
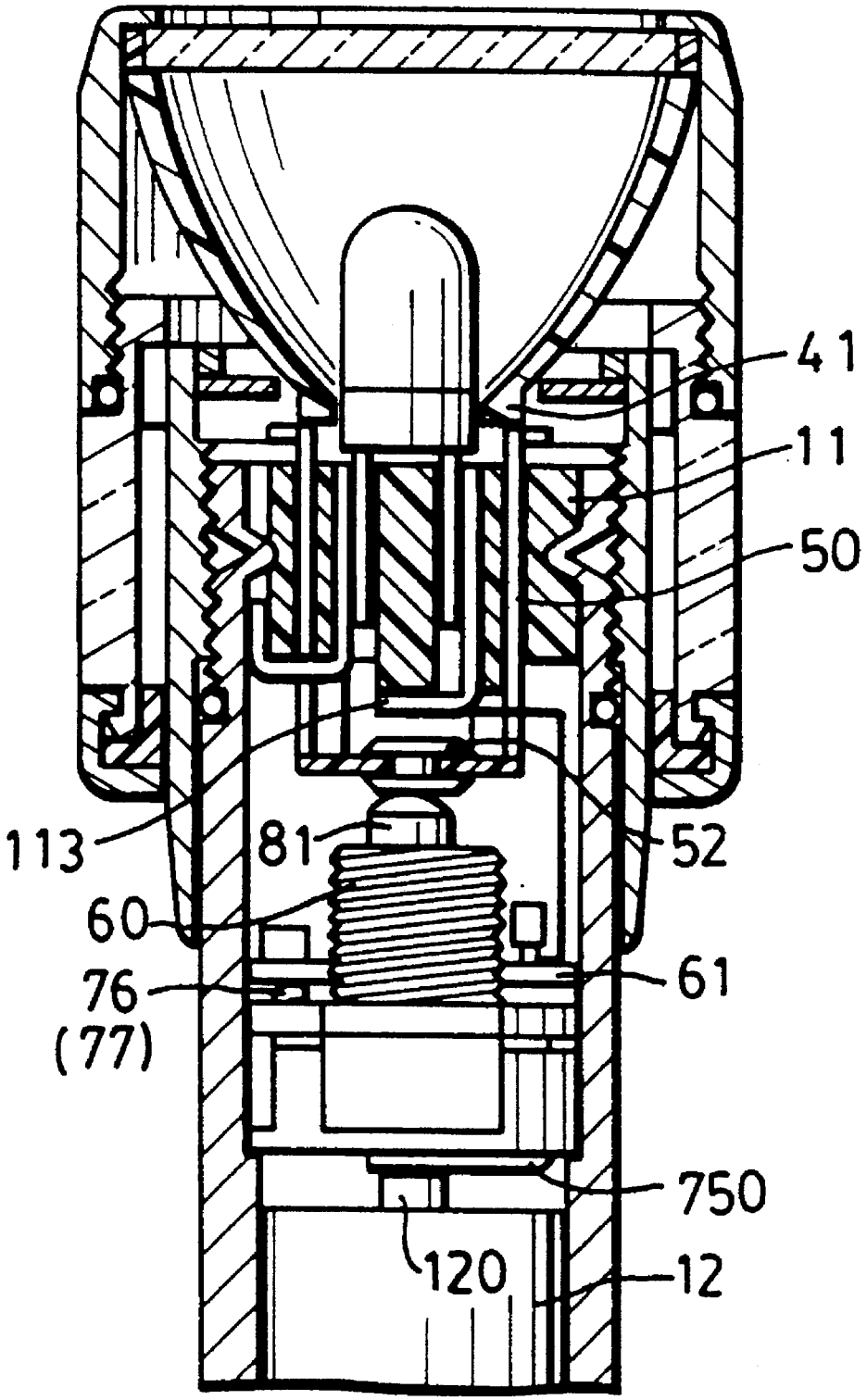
FIG. 17 is a fragmentary sectional view illustrating how the switch assembly of the second preferred embodiment is operated.

Referring again to FIG. 12, when installed in the barrel 10, the switch assembly 60 is disposed between the lamp base and the battery 12 such that the push member 50 abuts against the upper end portion of the push rod 81. The lamp 14 can be controlled to operate in a deactivated state, in a constant light output state, or in a blinking light output state by pulling the sleeve member 30, along with the head cap 40, to shift along the coupling member 20 in a direction toward the barrel 10. At this time, the tail end of the reflector 41 abuts against the upper end of the push member 50 to push the latter downwardly with respect to the lamp base 11, thereby causing the push member 50 to depress the push rod 81, as shown in FIG. 17.

Figure 21:
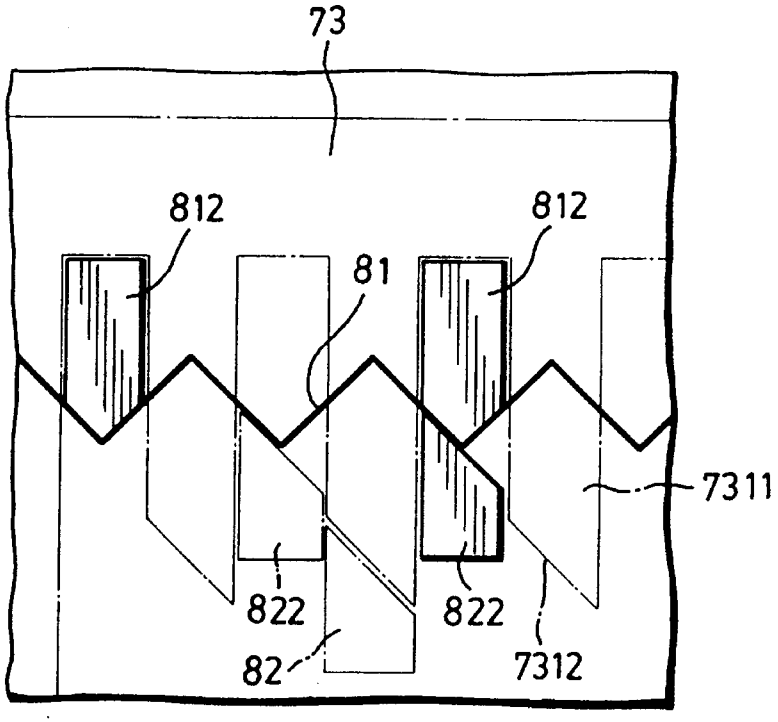
FIG. 21 is a view in which the annular inner wall of the cylindrical head of the seat member is translated onto a plane to illustrate operation of the switch assembly.

Referring to FIGS. 13, 16 and 21, the teeth 811 of the push rod 81 are initially misaligned with the teeth 821 of the rotatable rod 82. When pressure is applied on the upper end portion of the push rod 81, the push rod 81 moves axially downward relative to the seat member 70 to cause corresponding movement of the rotatable rod 82 and compression of the coil spring 84 so as to move the protrusions 822 of the rotatable rod 82 away from the slide grooves 7313 and so as to cause the teeth 811 of the push rod 81 to engage completely the teeth 821 of the rotatable rod 82, thereby rotating the rotatable rod 82 in order to misalign the protrusions 822 of the rotatable rod 82 with the slide grooves 7313 and cause the uppermost end surfaces of the protrusions 822 to abut against the lowermost end surface 7312 of the ribs 7311. When the applied pressure on the push rod 81 is removed, the coil spring 84 expands to bias the rotatable rod 82 toward the push rod 81, thereby causing the protrusions 822 of the rotatable rod 82 to move past the lowermost end surface 7312 of the ribs 7311 so as to extend once more into the slide grooves 7313 in order to rotate the rotatable rod 82.

It has thus been shown that application of pressure on the push rod 81 will cause the rotatable rod 82 to rotate by a predetermined angle. Since the base plate 831 of the conductive connector 83 is connected to the rotatable rod 82 via the connecting pins 824 and the notches 833, rotation of the rotatable rod 82 results in corresponding rotation of the conductive connector 83 to enable the latter to make or break electrical connection with the electrical contacts 75, 76, 77 on the seat member 70.

When the push rod 81 is pressed so that the base plate 831 is in the position shown in FIG. 18, the conductive contacts 834 on the conductive connector 83 are not in contact with any of the electrical contacts 75, 76, 77, thereby deactivating the lamp 14. The conductive connector 83 is in a switch-off position at this time.

Figure 19:
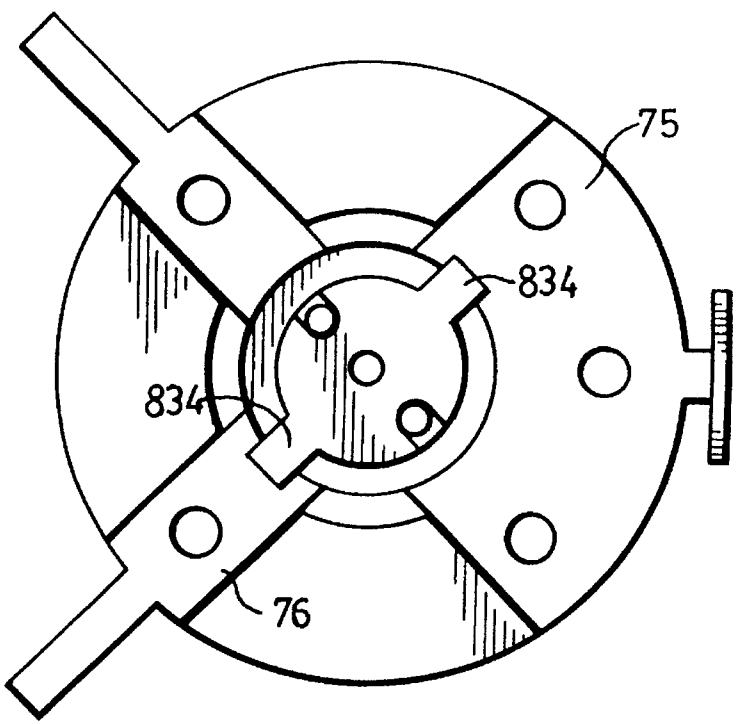
FIG. 19 is a bottom view illustrating the conductive connector and the electrical contacts on the seat member when the connector is in a first switch-on position.

When the push rod 81 is pressed so that the base plate 831 is in the position shown in FIG. 19, the conductive contacts 834 are connected electrically with the first and second electrical contacts 75, 76. Since the first and second electrical contacts 75, 76 are connected respectively to the battery 12 and to the lamp 14 via the first conductor 113, the lamp 14 is connected directly to the battery 12, thereby enabling the lamp 14 to generate a constant light output. The conductive connector 83 is in a first switch-on position at this time.

Figure 20:
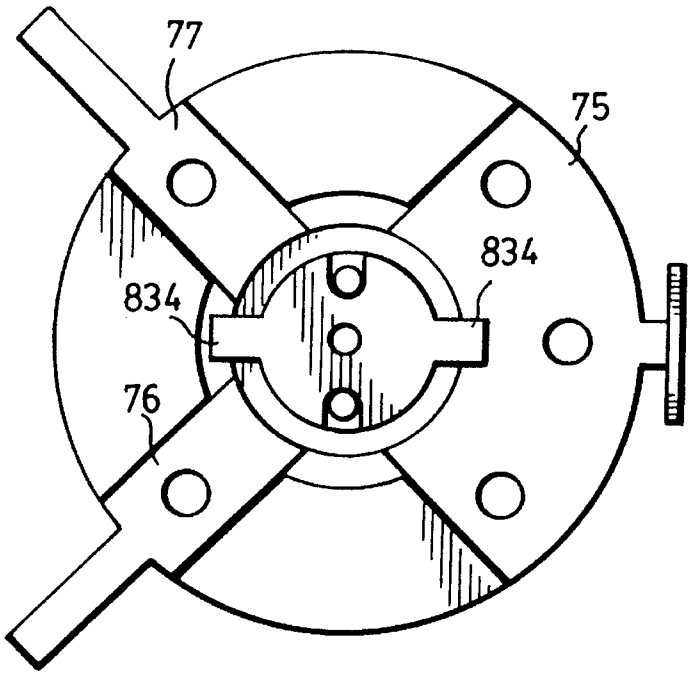
FIG. 20 is a bottom view illustrating the conductive connector and the electrical contacts on the seat member when the connector is moved from the first switch-on position to a second switch-on position.

When pressure is applied on the push rod 81 and then removed while the conductive connector 83 is in the first switch-on position, the conductive connector 83 rotates to the position shown in FIG. 20. One of the conductive contacts 834 is connected electrically with the first electrical contact 75. The remaining conductive contact 834 is not connected with any of the other electrical contacts 76, 77. Thus, the lamp 14 is deactivated at this time.

When pressure is applied on the push rod 81 and then removed while the conductive connector 83 is in the position shown in FIG. 20, the conductive connector 83 rotates such that the conductive contacts 834 are connected electrically with the first and third electrical contacts 75, 77, thereby connecting the pulse generating circuit 90 to the battery 12 in order to activate the pulse generating circuit 90 and generate a pulse train signal which is received by the lamp 14. The lamp 14 generates a blinking light output, and the conductive connector 83 is in a second switch-on position at this time.

Further pressing of the push rod 81 while the conductive connector 83 is in the second switch-on position will result in movement of the conductive connector 83 to the switch-off position shown in FIG. 18.

It has thus been shown that shifting of the sleeve member 30 can also be used to control operation of the lamp 14 in the deactivated state, in the constant light output state, or in the blinking light output state. Preferably, the coupling member 20 is shifted with respect to the barrel 10 such that the push projection 200 depresses the outward flanges 55 of the push member 50 to maintain the switch assembly 60 in a depressed state, thus keeping the lighting device of this embodiment in a deactivated state.

Figure 22:
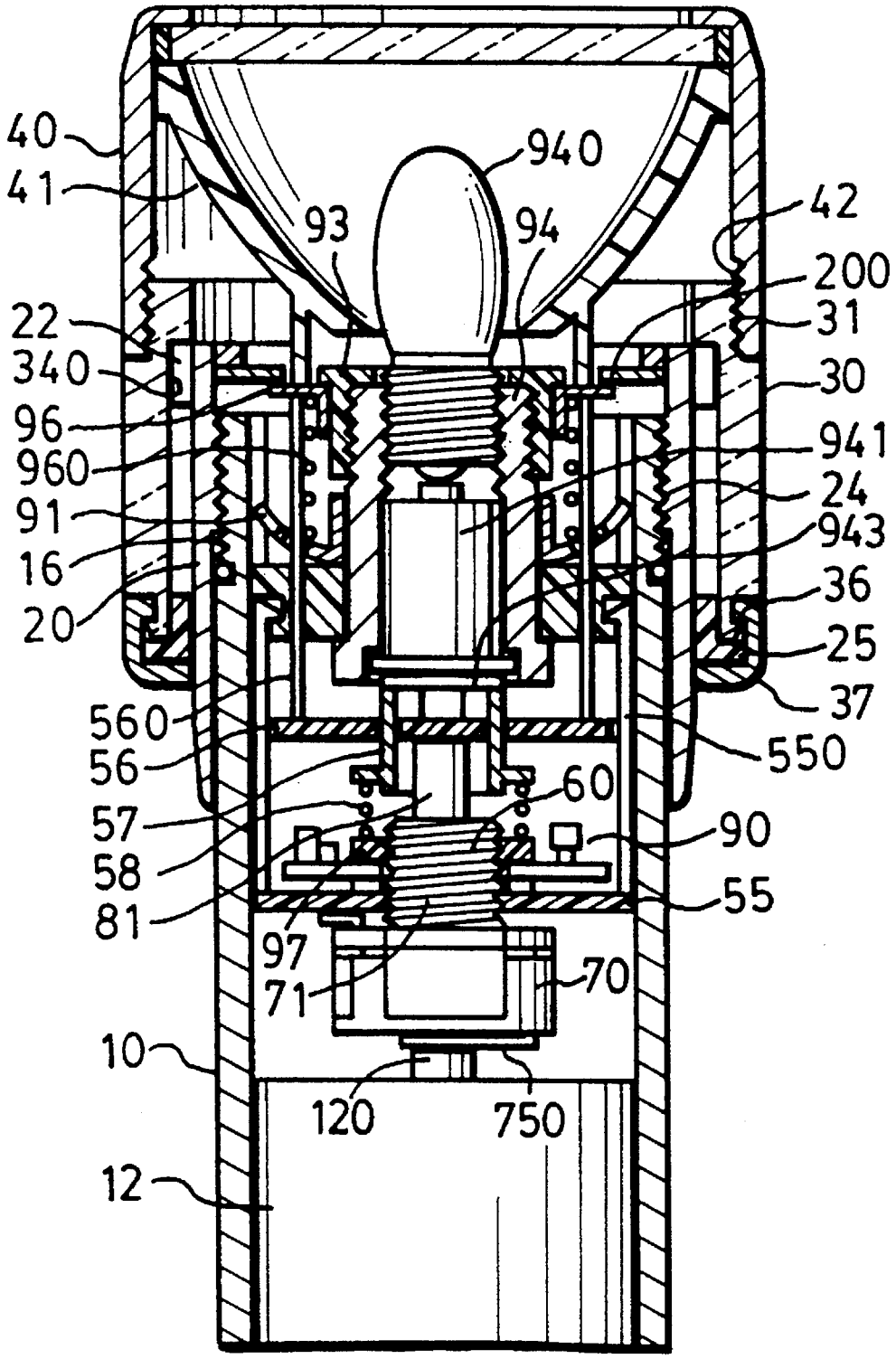
FIG. 22 is a fragmentary sectional view illustrating the third preferred embodiment of a multi-function lighting device according to the present invention.

The structure of the second preferred embodiment is suitable for a miniature flashlight and is modified for application to a larger flashlight. FIG. 22 illustrates the third preferred embodiment of a multi-function lighting device according to the present invention. The third preferred embodiment is in the form of a larger flashlight and comprises a conductive barrel 10 with a head assembly secured to a front end of the barrel 10. The head assembly, which includes a coupling member 20, a sleeve member 30 and a head cap 40, is similar to that of the previous embodiments in construction and will not be described in greater detail hereinbelow. The third preferred embodiment also comprises a switch assembly 60, similar to that of the second preferred embodiment in construction, which is operable to control operation of a lamp 940 in a deactivated state, in a constant light output state, or in a blinking light output state.

Figure 23:
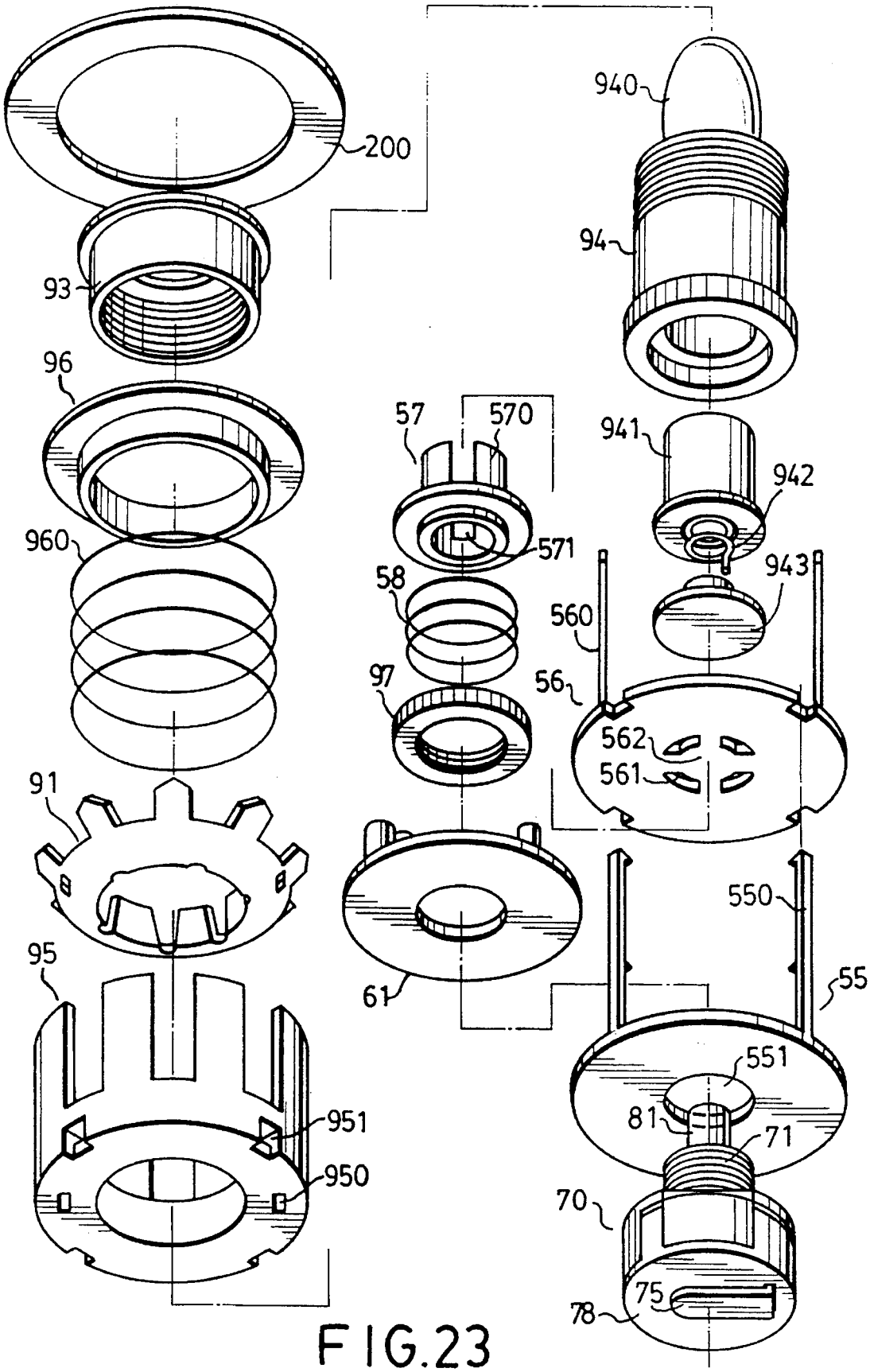
FIG. 23 is a perspective exploded view illustrating a lamp socket assembly and a push member of the third preferred embodiment.

Referring to FIGS. 22 and 23, the lamp base 11 and the push member 50 in the previous embodiments are replaced by a lamp socket assembly and a push member 56.

The lamp socket assembly includes a conductive tubular lamp holder 94 which has a top end that is threaded externally and that engages an insulating sleeve 93. The top end of the lamp holder 94 is threaded internally for engaging one end of a lamp 940. A conductive coupling unit 91 is disposed around the lamp holder 94 and connects electrically the barrel 10 and the lamp holder 94. A press ring 96 is sleeved on the insulating sleeve 93 and extends below the push projection 200 on the coupling member 20. A compression spring 960 biases the press ring 96 to abut against the push projection 200. A mounting unit 95 retains the lamp holder 94 and the coupling unit 91 in the barrel 10. The mounting unit 95 is formed with a pair of through-bores 950 and a pair of retaining holes 951.

A connector unit extends into the lamp holder 940 and is connected electrically to the lamp 940. The connector unit includes an insulating envelope 941 which extends into the rear end of the lamp holder 94 and which has a conductive compression spring 942 disposed therein. A conductive cover plate 943 covers an open bottom end of the insulating envelope 94.

A stationary base 55 is formed as a circular plate with a pair of upwardly extending hooking arms 550 and a central through-hole 551 formed therethrough. The push member 56 is formed as a circular plate with a pair of upwardly extending pushing arms 560 and four angularly displaced insert holes 561 formed therethrough. The connector unit further includes a tubular conductor 57 which is formed with four tubular wall segments 570 and which confines a through-hole 571 therethrough.

During assembly, the wall segments 570 of the tubular conductor 57 are extended slidably through the insert holes 561 in the push member 56. The pushing arms 561 of the push members 56 are then extended slidably through the through-bores 950 in the mounting unit 95 so as to abut against the press ring 96. The cylindrical head 71 of the seat member 70 extends through the through-hole 551 in the stationary base 55. The connector unit further includes a conductive nut 97 which engages threadedly the cylindrical head 71 so as to retain the switch assembly 60 on the circuit board 61, and a conductive spring 58 which is disposed between the tubular conductor 57 and the conductive nut 97 to connect electrically the lamp 14 and the switch assembly 60. Thereafter, the hooking arms 550 of the stationary base 55 engage the retaining holes 951 in the mounting unit 95. The push rod 81 of the button unit extends into the through-hole 571 of the tubular conductor 57 and abuts against the bottom side 562 of the push member 56 at this time. Preferably, the pulse generating circuit 90 on the circuit board 61 is disposed around the tubular conductor 57 to prevent the latter from contacting the pulse generating circuit 90 upon movement of the same. As with the previous embodiment, the plate portion 750 of the first electrical contact 75 extends along a bottom side of the bottom cover 78 and is in contact with a positive terminal 120 of the battery 12.

Figure 24:
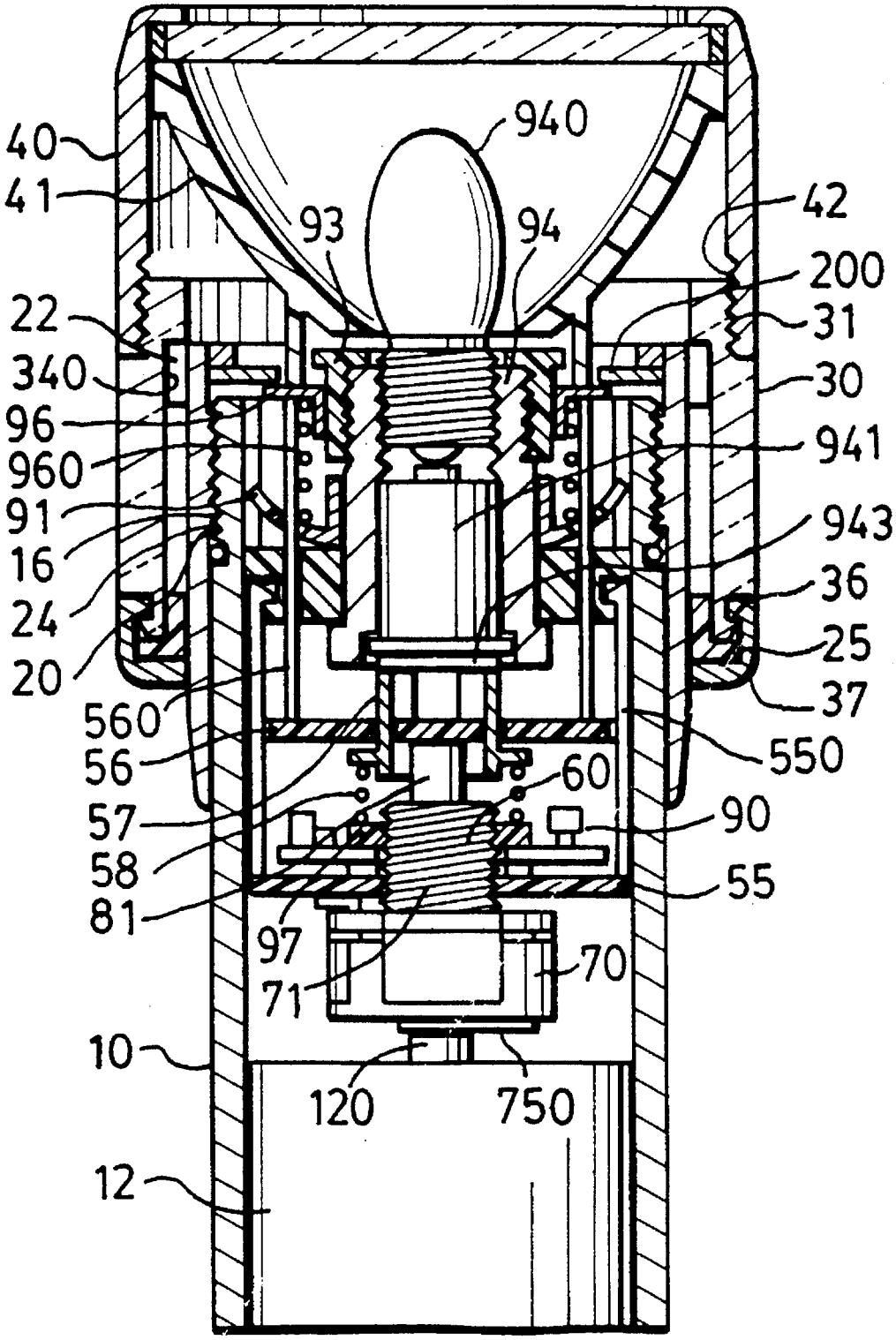
FIG. 24 is a fragmentary sectional view illustrating how the third preferred embodiment is activated.

By shifting the sleeve member 30 along the coupling member 20, the third preferred embodiment can also be used as a variable focusing flashlight or as a signaling baton in a manner similar to that of the previous embodiments. When the sleeve member 30 is pulled, along with the head cap 40, to slide along the coupling member 20 in a direction toward the barrel 10, the tail end of the reflector 41 abuts against the press ring 96 and pushes the latter toward the battery 12, thereby causing corresponding movement of the push member 56 to apply pressure on the push rod 81, as shown in FIG. 24. Thus, the switch assembly 60 can be operated so as to control the lamp 940 to generate a constant light output or a blinking light output in a manner similar to that of the second preferred embodiment. As with the previous embodiment, the coupling member 20 is shifted with respect to the barrel 10 such that the push projection 200 depresses the press ring 96 to maintain the switch assembly 60 in a depressed state, thus keeping the lighting device of this embodiment in a deactivated state.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A multi-function lighting device, comprising:

a barrel for housing a battery therein, said barrel having one end which is threaded externally;

a lamp base mounted in said one end of said barrel;

a lamp provided on said lamp base;

a switch unit disposed in said barrel for connecting selectively and electrically said battery to said lamp; and a head assembly including: a tubular coupling member threaded internally to engage threadably said one end of said barrel and provided with an inward push projection; a tubular sleeve member made of a light transmittable material and sleeved slidably on said coupling member; and a head cap secured to one end of said sleeve member and provided with a reflector therein;

said sleeve member being shiftable with respect to said coupling member between a first position, wherein said lamp extends into said reflector so that light may be directed axially, and a second position, wherein said lamp is located in said sleeve member so that light can pass transversely through said sleeve member;

said coupling member being shiftable with respect to said barrel so as to cause said push projection to depress said switch unit and control operation of said lamp.

2. The multi-function lighting device as claimed in claim 1, wherein said one end of said sleeve member is threaded externally, said head cap being threaded internally to engage threadably said one end of said sleeve member.

3. The multi-function lighting device as claimed in claim 1, wherein:

said one end of said sleeve member has an inner wall surface formed with a plurality of angularly spaced splines which define a plurality of spline grooves; and said coupling member is formed with at least one radial locking projection which extends removably into one of said spline grooves to lock non-rotatably said sleeve member onto said coupling member so as to permit rotation of said coupling member with said sleeve member relative to said barrel when said sleeve member is in said first position.

4. The multi-function lighting device as claimed in claim 3, wherein said coupling member has a seal ring which is disposed therearound and which is in tight frictional contact with said coupling member and said sleeve member to permit retention of said sleeve member at a desired position with respect to said coupling member.

5. The multi-function lighting device as claimed in claim 4, wherein said sleeve member has an opposite end provided with an annular cap to prevent removal of said seal ring.

6. The multi-function lighting device as claimed in claim 1, wherein said barrel has an opposite end with a tail cap mounted thereon, said tail cap having a compression spring provided thereon for urging said battery towards said one end of said barrel, said lamp base having a through bore formed therethrough, said switch unit including a push member which extends slidably through said through bore of said lamp base and which has a first end abutting against said battery and a second end abutting against said push projection, shifting of said coupling member in a first direction causing said push projection to depress said push member and move said battery away from said lamp base to break electrical connection between said lamp and said battery, shifting of said coupling member in an opposite second direction causing said compression spring to expand and push said battery toward said lamp base to make electrical connection between said lamp and said battery.

7. The multi-function lighting device as claimed in claim 6, wherein said push member has a plate portion which is disposed between said lamp base and said battery and which is formed with an opening and an upward extension that extends slidably into said through bore of said lamp base and which abuts against said push projection, said plate portion having an electrical contact provided in said opening for establishing electrical connection between said lamp and said battery.

8. The multi-function lighting device as claimed in claim 7, wherein said electrical contact is a conductive rivet mounted to said plate portion in said opening.

9. The multi-function lighting device as claimed in claim 7, wherein said battery has a positive terminal which extends toward said opening to serve as said electrical contact.

10. A multi-function lighting device, comprising: a barrel for housing a battery therein;

a lamp base mounted in one end of said barrel and formed with a through bore therethrough;

a lamp provided on said lamp base;

a head assembly including: a tubular coupling member secured to said one end of said barrel; a tubular sleeve member made of a light transmittable material and sleeved slidably on said coupling member; and a head cap secured to one end of said sleeve member and provided with a reflector therein;

said sleeve member being shiftable with respect to said coupling member between a first position, wherein said lamp extends into said reflector so that light may be directed axially, and a second position, wherein said lamp is located in said sleeve member so that light can pass transversely through said sleeve member;

a switch assembly mounted in said barrel and connected electrically to said battery and said lamp, said switch assembly being operable so as to interconnect electrically and selectively said battery and said lamp; and a push member which extends slidably through said through bore of said lamp base and which has a first end abutting against said switch assembly and a second end;

whereby, shifting of said sleeve member to said first position causes said reflector to depress said second end of said push member to result in operation of said switch assembly by said push member.

11. The multi-function lighting device as claimed in claim 10, wherein said one end of said barrel is threaded externally, said coupling member being threaded internally to engage threadably said one end of said barrel.

12. The multi-function lighting device as claimed in claim 11, wherein said coupling member is provided with an inward push projection, said second end of said push member being formed with an outward flange which extends below said push projection of said coupling member, said coupling member being shiftable with respect to said barrel so as to cause said push projection to depress said outward flange of said push member and permit maintaining of said switch assembly in a depressed state.

13. The multi-function lighting device as claimed in claim 10, wherein said switch assembly comprises:

an insulated hollow seat member having angularly spaced first, second and third electrical contacts mounted thereon, said first electrical contact being connected electrically to said battery, said second electrical contact being connected electrically to said lamp;

a pulse generating circuit having an input terminal connected electrically to said third electrical contact and an output terminal connected electrically to said lamp;

a conductive connector disposed rotatably in said seat member and formed with a pair of conductive contacts; and a spring-loaded button unit disposed in said seat member and having a rotatable rod which is connected to said conductive connector and a tubular push rod which is sleeved on said rotatable rod and which extends out of said seat member so as to abut against said first end of said push member;

application of pressure on said push rod by said push member enabling said push rod to rotate said rotatable rod to result in corresponding rotation of said conductive connector relative to said seat member among a switch-off position, wherein said conductive contacts of said conductive connector are not in contact with said electrical contacts on said seat member so as to turn off said lamp, a first switch-on position, wherein said conductive contacts of said conductive connector are in contact with said first and second electrical contacts on said seat member so as to control said lamp to generate a constant light output, and a second switch-on position, wherein said conductive contacts of said conductive connector are in contact with said first and third electrical contacts on said seat member so as to control said lamp to generate a blinking light output.

14. A multi-function lighting device, comprising:

a conductive barrel for housing a battery therein;

a lamp socket assembly mounted in one end of said barrel, said lamp socket assembly including a conductive tubular lamp holder with a lamp retained thereon, a connector unit which extends into said lamp holder and which is connected electrically to said lamp, a conductive coupling unit disposed around said lamp holder to connect electrically said barrel and said lamp holder, a press ring disposed slidably around said lamp holder, a spring for biasing said press ring outwardly of said barrel, and a mounting unit for retaining said lamp holder and said coupling unit in said one end of said barrel, said mounting unit having a through bore formed therethrough;

a head assembly including: a tubular coupling member secured to said one end of said barrel and provided with an inward push projection which is disposed above and which abuts normally against said press ring; a tubular sleeve member made of a light transmittable material and sleeved slidably on said coupling member; and a head cap secured to one end of said sleeve member and provided with a reflector therein;

said sleeve member being shiftable with respect to said coupling member between a first position, wherein said lamp extends into said reflector so that light may be directed axially, and a second position, wherein said lamp is located in said sleeve member so that light can pass transversely through said sleeve member;

a switch assembly mounted in said barrel and connected electrically to said battery and said connector unit, said switch assembly being operable so as to interconnect electrically and selectively said battery and said lamp; and a push member which extends slidably through said through bore of said mounting unit and which has a first end abutting against said switch assembly and a second end abutting against said press ring;

whereby, shifting of said sleeve member to said first position causes said reflector to depress said press ring to result in corresponding movement of said push member for operating said switch assembly.

15. The multi-function lighting device as claimed in claim 14, wherein said one end of said barrel is threaded externally, said coupling member being threaded internally to engage threadably said one end of said barrel.

* * * * *